United States Patent [19]

Combrink et al.

[11] Patent Number: 4,971,119

[45] Date of Patent: Nov. 20, 1990

[54] ARRANGEMENT FOR CLOSING VALVES OF VALVE BAGS WHICH ARE FILLED BY FILLING MACHINE

[75] Inventors: Alois Combrink, Oelde; Willi Vollenkemper, Oelde-Stromberg; Bernhard Stövesand, Ennigerloh, all of Fed. Rep. of Germany

[73] Assignee: Firma Haver & Boecker, Oelde, Fed. Rep. of Germany

[21] Appl. No.: 197,611

[22] Filed: May 23, 1988

[30] Foreign Application Priority Data

Apr. 2, 1988 [DE] Fed. Rep. of Germany ... 8804435[U]

[51] Int. Cl.[5] ..... B65B 7/06; B65B 43/26

[52] U.S. Cl. ..... 141/114; 141/10; 141/71; 141/73; 141/80; 141/166; 53/523; 53/527; 53/373; 53/375

[58] Field of Search ..... 141/10, 114, 68, 73, 141/80, 71, 165, 166; 53/523, 527, 289, 371, 373, 481, 374, 375, 378, 379, 387, 788, 477, 512, 510

[56] References Cited

U.S. PATENT DOCUMENTS

| | | | |
|---|---|---|---|
| 3,533,454 | 10/1970 | Tinsley | 141/10 |
| 4,128,116 | 12/1978 | Uthoff et al. | 141/1 |
| 4,172,750 | 10/1979 | Giolie | 53/477 X |
| 4,324,088 | 4/1982 | Yamashita et al. | 53/527 |
| 4,522,017 | 6/1985 | Scheffers | 53/570 |
| 4,612,965 | 9/1986 | McGregor | 141/114 |
| 4,662,978 | 5/1987 | Oki | 53/477 X |

FOREIGN PATENT DOCUMENTS

| | | | |
|---|---|---|---|
| 3409686 | 9/1985 | Fed. Rep. of Germany . | |
| 8203832 | 11/1982 | PCT Int'l Appl. | 141/114 |
| 2065591 | 7/1981 | United Kingdom | 141/10 |

*Primary Examiner*—Ernest G. Cusick
*Attorney, Agent, or Firm*—Michael J. Striker

[57] ABSTRACT

An arrangement for closing valves of valve bags filled by a filling machine comprises at least one conveyor arranged to transport valve bags in flatly lying position and a unit for closing the valves of the valve bags and associated with the conveyor. At least one abutment is located above the conveyor and is turnable outwardly beyond a movement region of the valve bags. Two first parallel spaced plates and two second parallel spaced plates are arranged above the conveyor and are movable transversely to a transporting direction of the latter to provide, respectively, for orienting the filled valve bags and for preparing the filled valve bags for closing of their valves.

27 Claims, 7 Drawing Sheets

ARRANGEMENT FOR CLOSING VALVES OF VALVE BAGS WHICH ARE FILLED BY FILLING MACHINE

BACKGROUND OF THE INVENTION

The invention relates to an arrangement for closing valves of valve bags or sacks which are filled by a filling machine, and particularly to such an arrangement which is provided with a transporting device for the filled valve bags.

Arrangements of the above mentioned general type are known in the art. One of such arrangements is disclosed, for example in German document No. DE-OS 34 09 686. The transporting device in this arrangement is formed as a tilting device for pulling the filled bags from a filling station of the filling machine. The valve working tools move one after the other in the valve of the tilted valve bag for opening and cleaning the latter, wherein the end of the valve which faces the interior of the bag is squeezed out. Then the inner coating of the valve is activated, and the valve is flattened by applying a mechanical pressure so that the inner sides of the valve are connected by glueing or welding.

The above described arrangement generally operates in a satisfactory manner. However, it possesses the disadvantage in that the working tools which are required for closing of the valve must perform the respective working step in a tilted position of the filled bag. Such a position is especially disadvantageous since the valve bags are designed so that the valve automatically opens under the pressure of the filling material, which is however not possible in a tilted position since thereby a free space is formed in the inner region which is associated with the valve. Moreover, folds are produced which after the connection of the inner surfaces of the valve lead to not tight passages. However, especially in the event of dust-like filling materials, the escape of the filling material must be prevented. The reason is that the outer surfaces of the bag must not be dirtied, since otherwise the aggregates which are arranged after the filling in, such as for example, a pelletizer are too much dirtied. Moreover, it is also of a disadvantage that the device for closing the valves is formed as an auxiliary aggregate of the filling machine and must operate in a cycle with the machine. The aforementioned arrangement is especially not suitable for machines with high bag output, such as rotatable filling machines with several filling pipes.

SUMMARY OF THE INVENTION

Accordingly, it is an object of the present invention to provide an arrangement of the abovementioned general type, which avoids the disadvantages of the prior art.

More particularly, it is an object of the present invention to provide an arrangement of the abovementioned general type, which has a high output, operates independently of the filling machine, and also insures that the valve is located in a proper position relative to the working tools and no free space is formed in the interior of the valve bag in the region of the valve.

In keeping with these objects and with others which will become apparent hereinafter, one feature of the present invention resides, briefly stated, in an arrangement of the abovementioned type in which a transporting device includes at least one conveyor which is arranged after a filling machine for transporting flatly lying valve bags, the required working tools for closing the valve being associated with the conveyor, at least one abutment which is turnable from a movement region of the valve bag is located above a transporting band of the conveyor, and two parallel orienting plates and/or preparing plates are arranged parallel to one another and movable transversely to the transporting direction of the conveyor.

The new arrangement can operate as a self-contained machine. It is not absolutely necessary to throw the bags from the filling pipes directly onto the conveyor. Between the filling machine and the arrangement for closing the valves, an intermediate transporting unit can be provided, for example a discharge band of a rotatable filling machine. Since the flat bags are transported in a flatly lying position, the filling material acts upon the valve with a pressure which is at least so high that no empty space is formed in the region of the valve. By the cooperation of the orienting plates with the abutments, the valve always is located at the same place so that the working tool can be placed in a functionally accurate manner.

In accordance with a further feature of the present invention, the transporting device includes two conveyors which are arranged one after the other, each conveyor in its rear region as considered in the running direction of the filled bags is provided with an abutment which is turnable out of the movement region of the valve bag, the first conveyor is provided with the working tools for opening and/or for cleaning the valve and for adjusting the orienting plates transversely to the transporting direction to a respective bag width, while the second conveyor is provided with working tools for activating the inner surfaces of the valve and for closing the valve as well as with the preparing plates which are movable in intervals with respect to the filled bag. Because of the separation of the transporting device into two conveyors, the closing of the valve of a valve bag can be performed in an output-increasing manner in two stations. The orienting plates which are associated with the first conveyor are adjusted to the respective bag width and then do not move, while the preparing plates associated with the second conveyor are adjusted to the respective bag width and moreover move transversely to the transporting direction to one another as long as the bag abuts against the abutment. This operational position of the preparing plates is adjusted so that the bag is preformed without being opened. Thereby also slipping is prevented when the closing tool engages the bag.

For pressing the filling material especially strongly in the corner of the valve bag which is provided with the valve, it is advantageous when at least one of the preparing plates, advantageously both preparing plates, are formed as pressing bodies. By the pressing body or the pressing bodies the filling material is displaced and an especially high counterpressure for a closing tool which is placed outside on the bottom of the bag is produced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
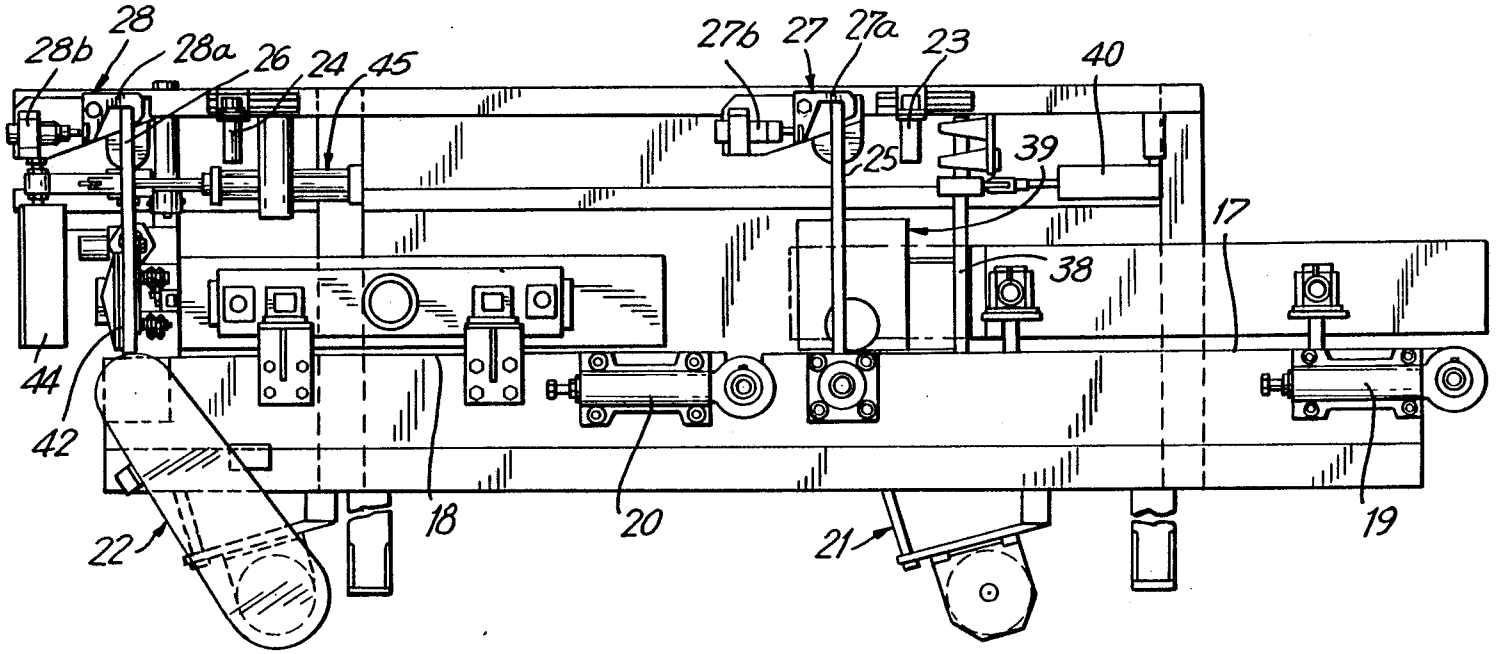
FIG. 1 is a view which schematically shows an arrangement for closing valves of valve bags filled with a filling machine, in accordance with the present invention.

An arrangement for closing valves of valve bags which are filled by a filling machine has a transporting device 10 for filled bags. The transporting device 10 includes two band conveyors 11 and 12 arranged one behind the other. The running direction of the filled bag is identified with an arrow A. The band conveyors 11 and 12 have rear drive rollers 13 and 14 as considered in a transporting direction, and front deviating rollers 15, 16 as considered in the transporting direction. The band conveyors 11 and 12 have relatively wide bands 17 and 18.

Figure 7:
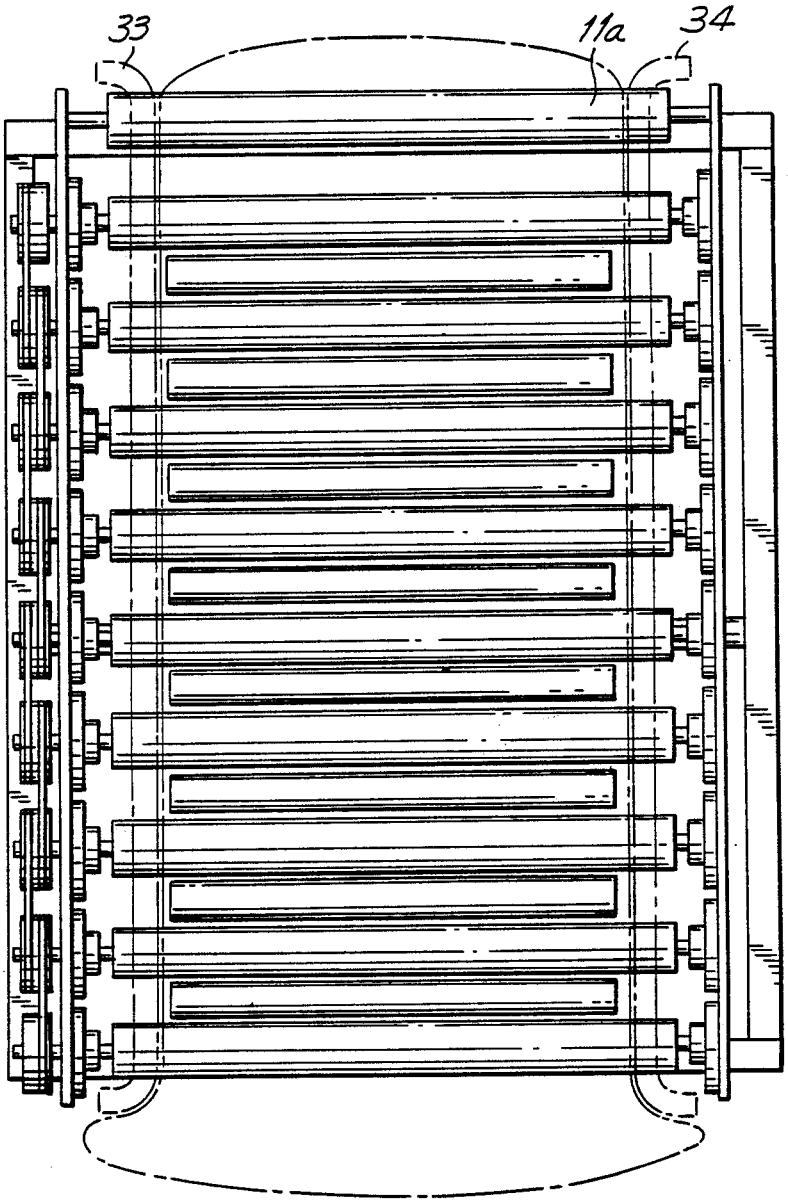
FIG. 7 is a plan view showing a portion of a roller conveyor for transporting bags.

The deviating rollers 15 and 16 are movable in a horizontal plane by means of a respective tensioning device 19 and 20 for tensioning the bands 17 and 18. The drive roller 13 of the band conveyor 11 is driven by an electromotor drive 21, while the drive roller 14 of the band conveyor 12 is driven by an electro-motor drive 22. The drive of the band conveyors 11 and 12 is performed intermittently by a not shown control, by sensing of the bags transported by the band conveyors 11 and 12 with sensors 23 and 24. The sensors are formed in the shown example as generally known light barriers. For limiting the structural length of the transporting device 10, the band conveyors 11 and 12 are formed in an especially advantageous manner for receiving a single individual bag. Instead of band conveyors, roller conveyors such as shown in FIG. 7 and having a plurality of rollers 11*a* can be used.

Behind the region of each band conveyor 11 and 12 as considered in the running direction of the bags, two turnable abutments 25 and 26 are provided. They are turnable about horizontal axes which are located above the band conveyors 11 and 12. The forwardly running ends of the filled bags abut against the abutments 25 and 26 which are turned into the movement region of the bags. Thereby an extremely accurate orientation of the bags is achieved. For preventing any displacements, the abutments 25 and 26 are secured in their operational position by locking devices 27 and 28. The locking devices include blocking latches 27*a* and 28*a* and cylinder-piston units 27*b* and 28*b* for actuating the blocking latches. The operation of the locking device is clearly illustrated in FIG. 2.

Two parallel orienting plates 31 and 32 are arranged at a distance from one another and associated with the band conveyor 11. On the other hand, two parallel bag preparing plates 33 and 34 are arranged at a distance from one another and associated with the band conveyor 12. The orienting plates and the bag preparing plates are arranged perpendicularly to the transporting bands conveyors 11 and 12. A gap of a small height is provided between the lower edges of the orienting plates 31 and 32 and the bag preparing plates 33 and 34, and the transporting bands conveyors 11 and 12. The orienting plates 31 and 32 are suspended on respective two guiding rods 35 and 36. Each guiding rod 35 and 36 is formed in the shown example as a round rod movable in its longitudinal direction by means of an adjusting drive 37. The adjusting drive 37 adjusts the distance between the orienting plates 31 and 32 to the respective width of the bag. The preparing plates 33 and 34 are also suspended on the respective two guiding rods 35*a* and 36*a* which have a substantially four-cornered cross-section. For adjusting the distance between the preparing plates to the respective width of the bags, each guiding rod 35*a* and 36*a* is also associated with an adjusting drive 37. The preparing plates 33 and 34 can be moved to an operative position and to an inoperative position by means of a cylinder-piston unit 33*a* or 34*a*. In their operational position the preparing plates 33 and 34 are brought into abutment against the bag, and then it is transported against the abutment 26. After closing of the valve, the preparing plates 33 and 34 are withdrawn to their inoperative position.

Figure 2:
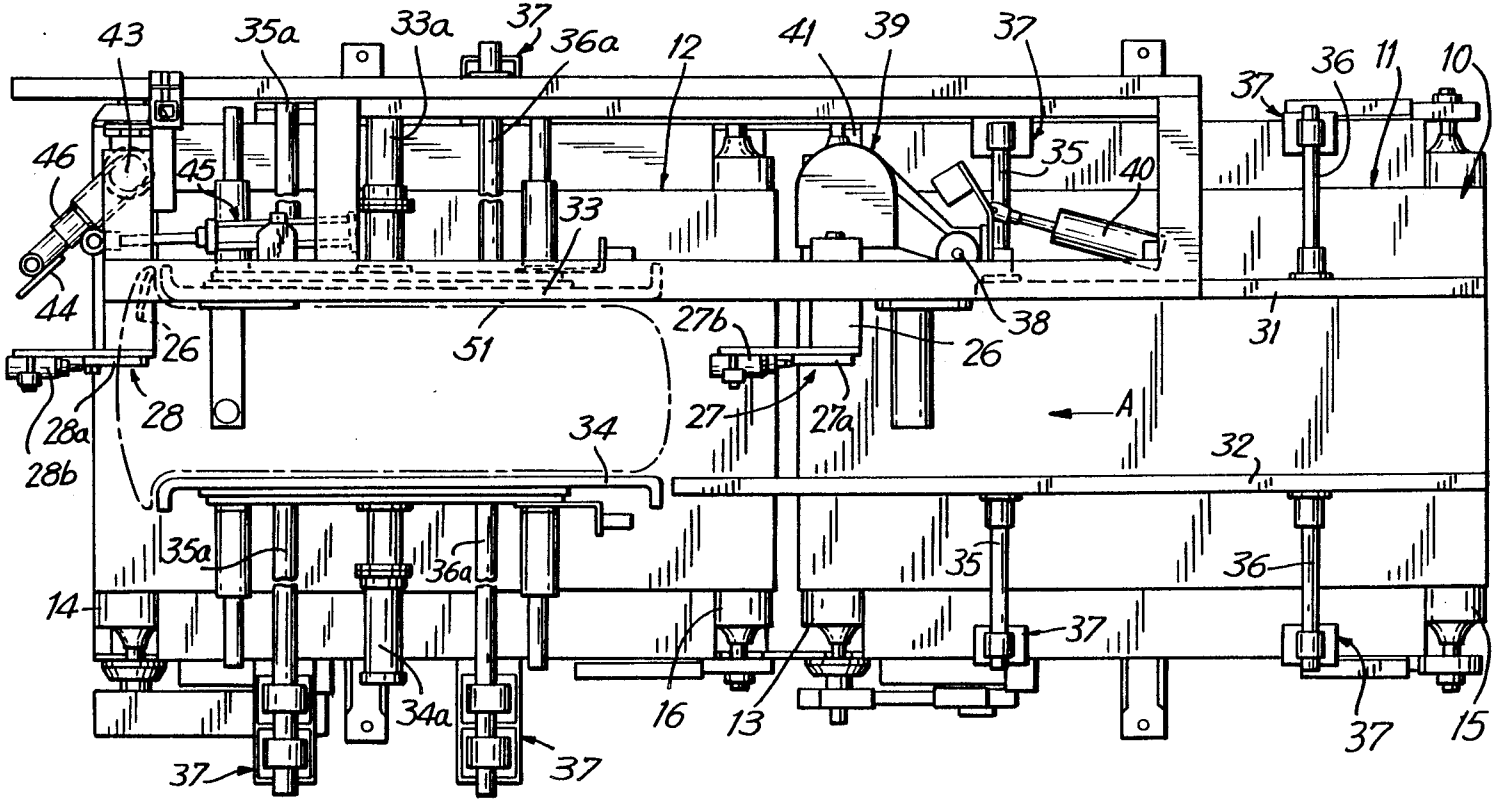
FIG. 2 is a plan view of the arrangement for closing the valves of FIG. 1 in accordance with the present invention.

In the region of the rear end of the first band conveyor 11, a device 39 for cleaning and in some case for opening the valve is provided. The device 39 is turnable about a vertical axis 38. The actuation of the device is performed by means of a cylinder-piston unit 40. The device 39 substantially includes a bell which is open in direction toward the running bags and is provided with a pressure air connection. As shown in FIG. 2, the vertical turning axis of the device lies outside of the bell. When the bag abuts against the abutment 25, the bell is turned from an inoperative position shown in FIG. 2 in a counterclockwise direction. Thereby the edges which are opposite to the turning axis 38 abut against the region of the valve which faces toward the interior of the bag so that it is squeezed out. Then the cleaning is performed, which includes a blowing and a subsequent suction. A hose 41 serves for performing the suction. Then the device 39 or the bell is turned back in clockwise direction to its inoperative position. The abutment 25 is unlocked, the drive 21 is turned on so that the bag is transported from the first band conveyor 11 to the band conveyor 12.

First of all the abutment 25 is unlocked. By a transportation of the bag it is moved in a clockwise direction. As long as the bag leaves the first band conveyor 11, it turns back to its vertical operative position. By the respective switching of the cylinder-piston unit 27*b* it is locked. During the transportation of the bag from the first band conveyor 11 to the second band conveyor 12, the next bag is transported. The bag is transported onto the second conveyor 12 until it abuts against the abutment 26 which is fixed by the locking device 28. By joint movement of the preparing plates 33 and 34, the bag is exactly oriented and prepared. By means of a hot air nozzle 42, hot air is blown in the opened valve for activating the inner surface of the valve. For this purpose, the hot air nozzle 42 is moved by means of a pressure air cylinder-piston unit in front of the valve opening. After heating, the hot air nozzle 42 is withdrawn. The duration of the heating is regulated by the control of the machine. Simultaneously with the withdrawal, a pressing plate 44 which is turnable about an axis 43 is pressed to the valve under the action of a force accumulator which in the shown example is formed by a cylinder-piston unit 45 connected with a pressure plate support 46. Thereby the valve hose forms two parallel valve sides which abut against one another and have thermally activated inner sides. Under the action of the activation and pressing they form a welding. After a sufficiently long pressing time, the preparing plates 33 and 34 as well as the pressing plate 44 are withdrawn to their initial position, and then the locking of the abutment 26 is released. By turning on of the drive 22, the bag is then transported by the band conveyor 12.

Figure 3:
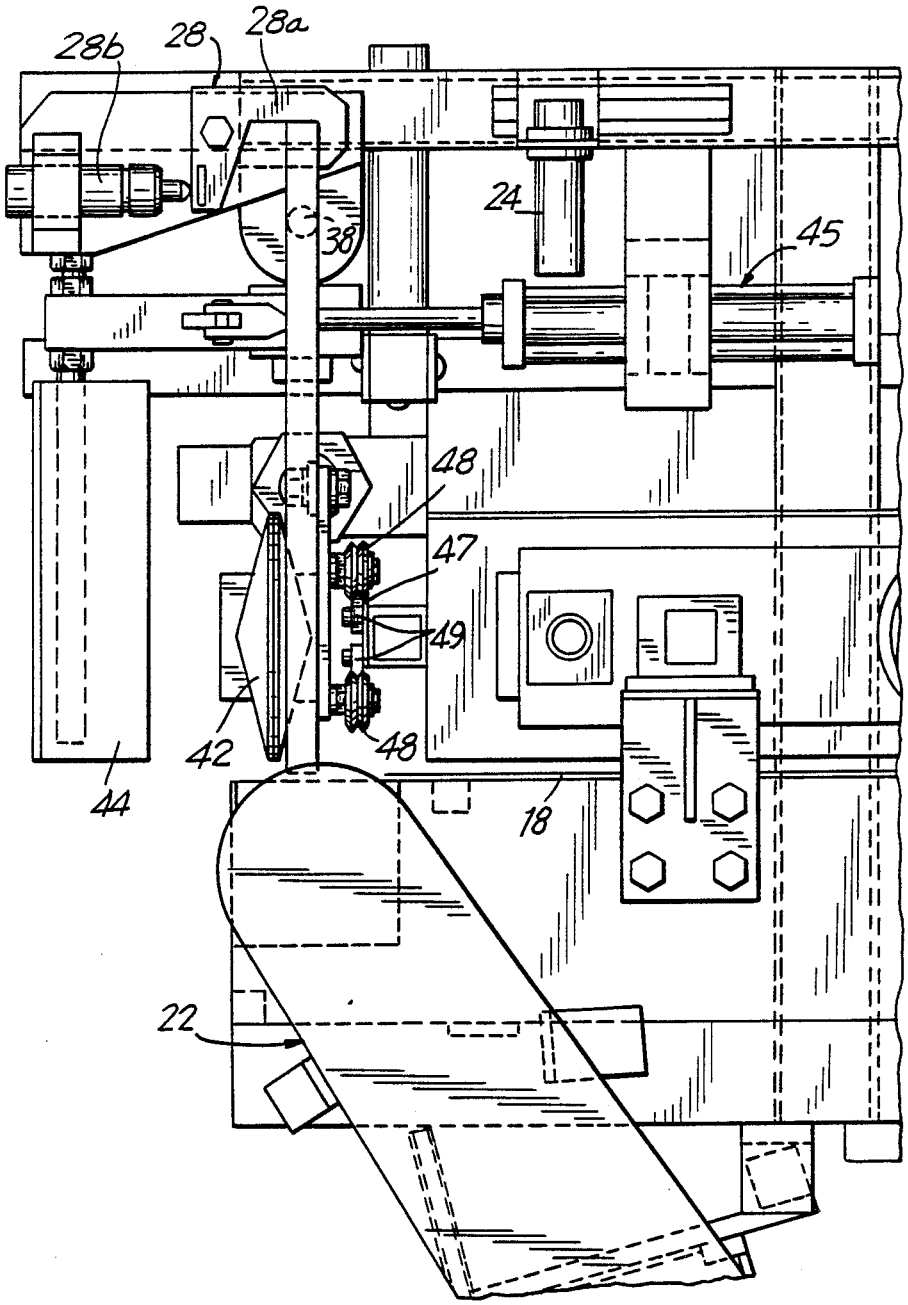
FIG. 3 is a view showing a portion identified as III in FIG. 1, on an enlarged scale.
Figure 4:
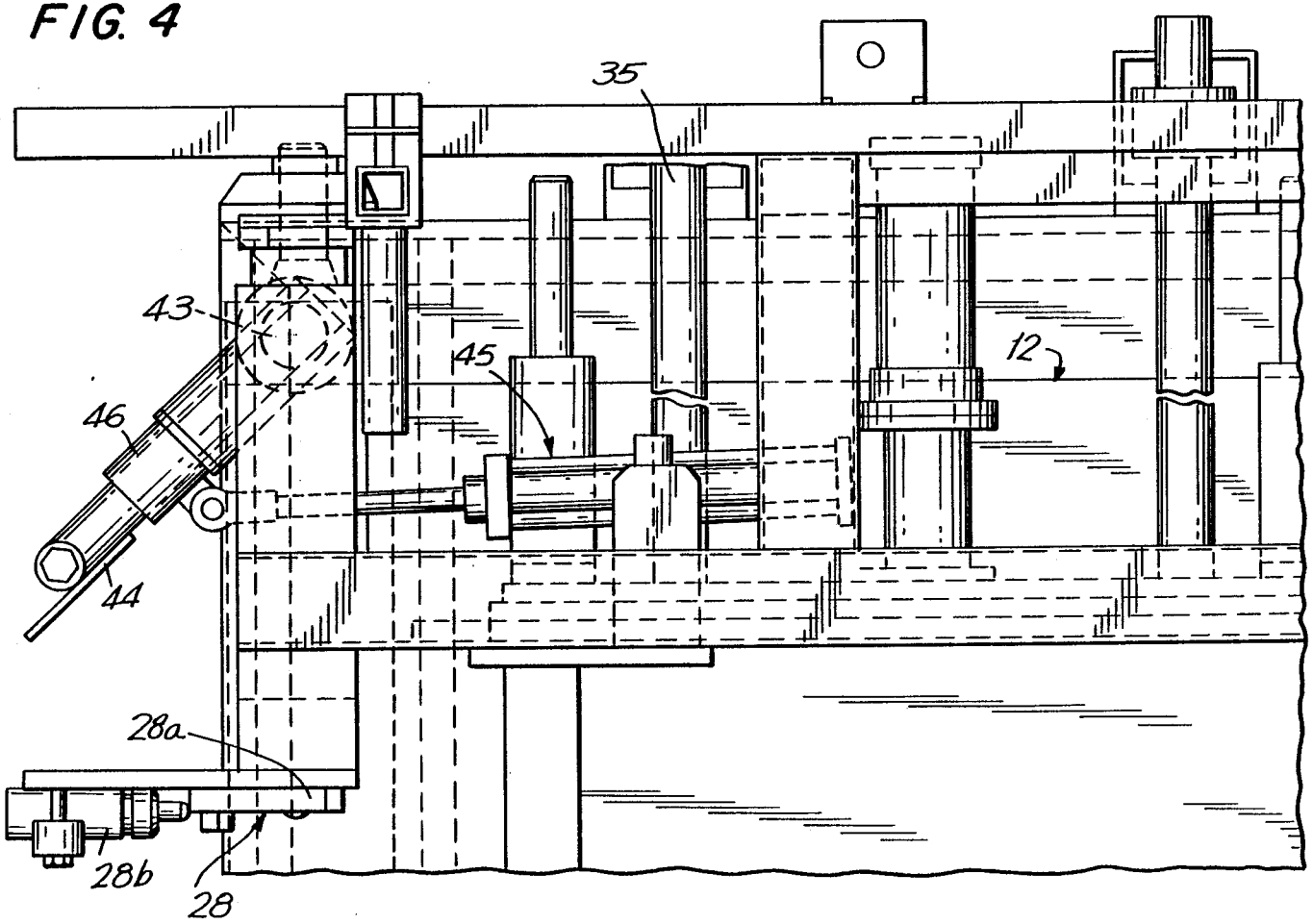
FIG. 4 is a view showing a portion identified as IV in FIG. 2, on an enlarged scale.

As can be seen from FIG. 3, the hot air nozzle 42 is arranged on a holder 47 which is movable transversely to the running direction of the band conveyor 12. The holder has a pair of guiding rollers 48 which roll on a stationary guiding rail 49. As shown in FIG. 4, the abutment 26 of the second band conveyor 12 is located above the drive roller 14. This figure also shows that the vertical turning axis 43 for the pressing plate 44 is located laterally near the band 18 of the band conveyor 12.

The drives 21 and 22 can be switched to run in synchronism with one another, so that a bag is transferred from the first band conveyor 11 to the second band conveyor 12 and simultaneously a bag is supplied to the band conveyor 11. The bags then simultaneously abut against the abutment 25 and 26. The drives 21 and 22 are turnable on, however, in practice independently of one another, since a synchronous running is not practically justified when the conveyors operate in a not cycle independently of one another.

Instead of the hot air nozzle 42 it is also possible to use a pressing plate 44 for activating the inner surfaces of the valve. Instead of the band conveyors 11 and 12, also roller conveyors with driven rollers can be used.

Figure 5:
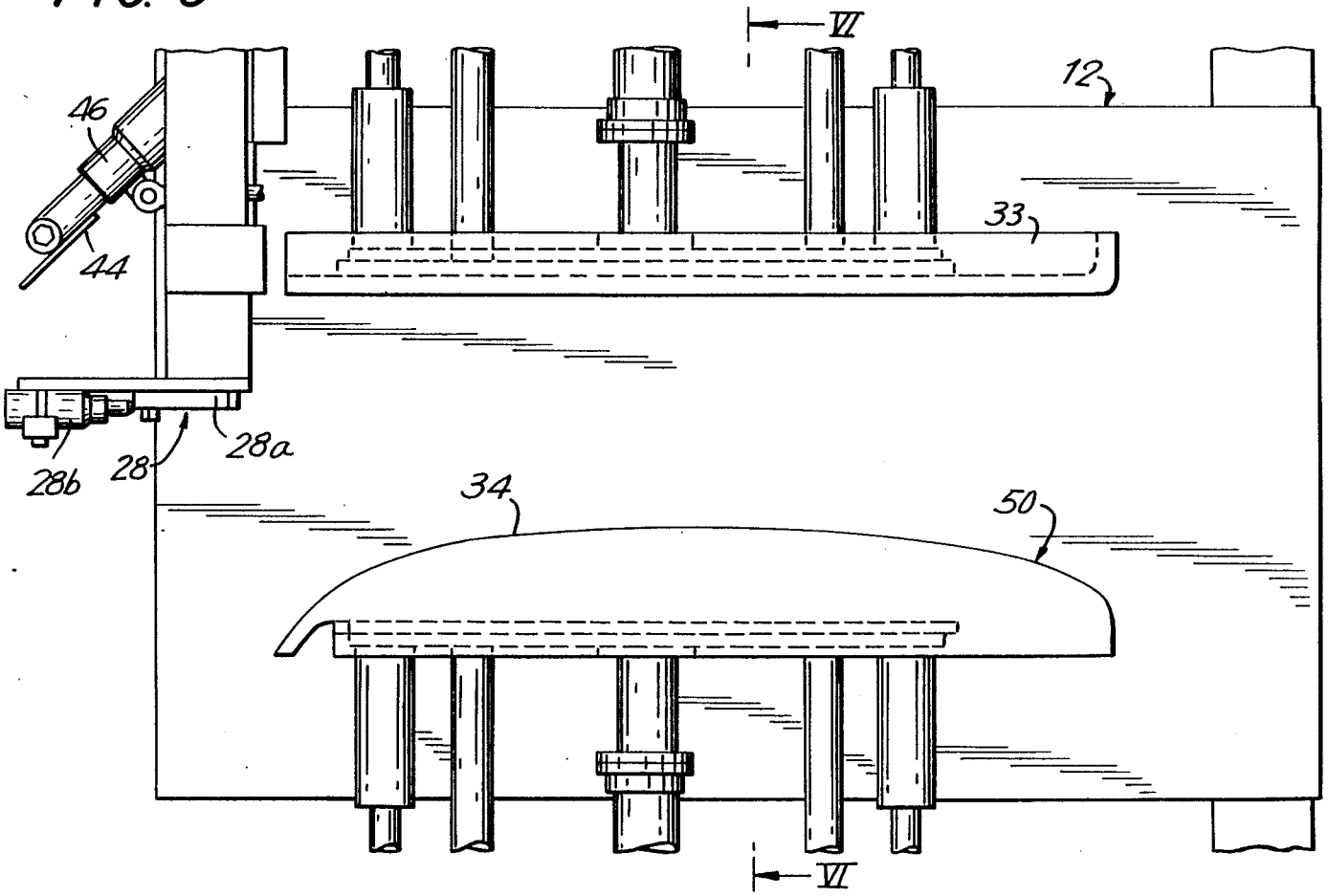
FIG. 5 is a partial plan view of an orienting plate formed as a pressing body.
Figure 6:
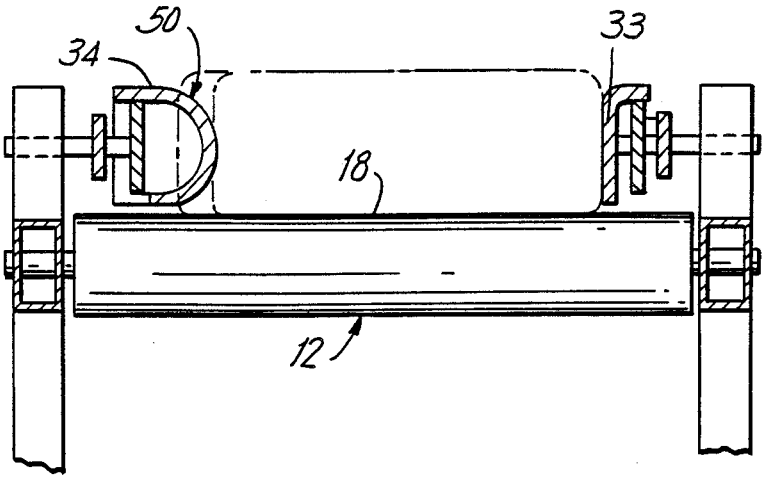
FIG. 6 is a view showing a section taken along the line VI—VI in FIG. 5.

FIGS. 5 and 6 show the preparing plate 34 which is located opposite to the valve and formed as a press body 50. The press body is a sheet-shaped part and curved both on its projection and in its cross-section. In contrast to the shown embodiment, it is advantageous to form both preparing plates 33 and 34 as press bodies. However, it can be recommended that the preparing plate 33 which is associated with the valve side is formed as a press body.

The conveyors 11 and 12 with their drives 21 and 22, abutments 25 and 26 and the associated locking devices 27 and 28 are substantially identical. As can be seen from FIG. 2, the preparing plates 33 and 34 are arcuately outwardly bent at their end sides. A valve bag 51 located therebetween is therefore so prepared that at least the valve region abuts against the arc. Thereby an abutment for the pressing plate 44 is provided.

It will be understood that each of the elements described above, or two or more together, may also find a useful application in other types of constructions differing from the types described above.

While the invention has been illustrated and described as embodied in an arrangement for closing valves of valve bags filled by means of filling machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. An arrangement for closing valves of valve bags filled by a filling machine, said arrangement comprising means for transporting filled valve bags and including at least one conveyor for transporting the filled valve bags in a flatly lying positions; means associated with said at least one conveyor for closing the valves; at least one abutment arranged above said at least one conveyor and pivotable outwardly beyond a movement region of the bags of said at least one conveyor for stopping a filled valve bag to be moved on said at least one conveyor; first two parallel spaced plates arranged above said at least one conveyor for orienting the filled valve bags to be moved on said at least one conveyor; and second two parallel spaced plates arranged above said at least one conveyor for preparing the filled valve bags for closing the valves of the filled valve bags, said first two plates and second two plates being movable transversely to a transporting direction of said at least one conveyor.

2. An arrangement as defined in claim 1, wherein one of said second two plates is associated with said means for closing the valve and formed as a press body.

3. An arrangement as defined in claim 1, wherein said second two plates are formed as press bodies.

4. An arrangement as defined in claim 1, wherein said at lest one conveyor has a predetermined length and formed for transporting the valve bags of a predetermined height, each of said first two plates and said second two plates extending over the whole length of said at least one conveyor and over the height of the valve bags.

5. An arrangement as defined in claim 1, wherein said means for closing the valves includes a pressing plate which is turnable about a vertical axis.

6. An arrangement as defined in claim 1, wherein said means for closing the valves includes a pressing plate which is turnable about a vertical axis and provided with a turning arm; and further comprising drive means connected with said turning arm for turning said pressing plate between a pressing position and a release position.

7. An arrangement as defined in claim 6, wherein said drive means includes a cylinder-piston unit.

8. An arrangement as defined in claim 1, wherein said means for closing the valves includes a pressing plate, said at least one conveyor having a central longitudinal axis, said pressing plate being offset relative to said central longitudinal axis of said at least one conveyor.

9. An arrangement as defined in claim 8, wherein said at least one conveyor has a longitudinal side, said pressing plate being arranged in the region of said longitudinal side of said at least one conveyor.

10. An arrangement as defined in claim 1, wherein said at least one conveyor is formed as a band conveyor.

11. An arrangement as defined in claim 1, wherein said at least one conveyor is formed as a roller conveyor.

12. An arrangement as defined in claim 1, wherein said second two plates, each of is formed as a press body, each of said press bodies being formed as a shaped sheet which is curved in the transporting direction and also in its cross-section.

13. An arrangement as defined in claim 1, and further comprising means for moving each of said second two plates transversely to the transporting direction; and means for adjusting each of the second two plates to a position in dependence on a width of the bag.

14. An arrangement as defined in claim 13, wherein said means for adjusting each of said second two plates includes a cylinder-piston unit.

15. An arrangement as defined in claim 13, wherein said means for adjusting each of said second two plates includes an adjusting drive associated with each of said second two plates.

16. An arrangement as defined in claim 1, wherein said at least one conveyor has a transporting band, said at least one abutment and said first two and second two plates being arranged above said transporting band of said at least one conveyor.

17. An arrangement for closing valves of valve bags filled by a filling machine, said arrangement comprising means for transporting filled valve bags and including two conveyors arranged one after another in a transporting direction of the filled valve bags and having each a rear region; first means associated with a first one of said two conveyors for effecting at least one of opening and cleaning the valves; second means associated with a second of said two conveyors for activating inner surfaces of the valves and for closing the valves; first and second abutments pivotably arranged above said first and second conveyors, respectively, in the rear region of a respective one of said first and second conveyors; first two parallel spaced plates arranged above said first conveyor for orienting the filled valve bags to be moved on said first conveyor; and second two parallel spaced plates arranged above said second conveyor for preparing the filled valve bags to be moved on said first conveyor for closing the valves of the filled valve bags, said first two and second two plates being movable transversely to the transporting direction of the filled valve bags to adjust the distance between two respective plates in accordance with a width of a filled valve bag to be moved by said transporting means.

18. An arrangement as defined in claim 17, wherein said each of said conveyors is formed so as to receive a single filled bag and provided with a intermittently actuatable drive.

19. An arrangement as defined in claim 17, wherein said conveyor are driven and connected with one another so that they operate in a cycle relative to one anther.

20. An arrangement as defined in claim 17, wherein said conveyors are driven and connected with one another so that they operate in synchronism with one another.

21. An arrangement as defined in claim 17, wherein each of said conveyors has an upper run, each of said abutments being turnable about a horizontal axis which is located at a distance from said upper run of a respective one of said conveyors, each of said abutments is turnable to an abutment position; and further comprising means for locking each of said abutments in said abutments position.

22. An arrangement as defined in claim 21, wherein each of said locking means for a respective one of said abutments includes a blocking latch which is turnable about a horizontal axis and a cylinder-piston unit operative for actuating said blocking latch.

23. An arrangement as defined in claim 17, wherein each of said conveyors has a central longitudinal axis, each of said abutments being laterally offset relative to said central longitudinal axis of each of said conveyors.

24. An arrangement as defined in claim 17, wherein said first means includes a hood-like member which is turnable about a vertical axis and opens toward the valve bags, and a conduit connected with said hood.

25. An arrangement as defined in claim 24, wherein said conduit connected with said hood is a flexible hose.

26. An arrangement as defined in claim 17, wherein said second means includes a hot air nozzle.

27. An arrangement as defined in claim 26, and further comprising means for guiding said hot air nozzle and including a stationary guiding rail, at least two pairs of guiding rollers which roll over said guiding rail, and a holder which holds said hot air nozzle immovable in a horizontal plane, said holder being connected with said at least two pairs of guiding rollers.

* * * * *